United States Patent [19]

Regel

[11] Patent Number: 4,796,845

[45] Date of Patent: Jan. 10, 1989

[54] SUPPORT DEVICE FOR MODULAR WALL UNIT

[76] Inventor: Edmond R. Regel, 6761 Oldstage Rd., Boulder, Colo. 80302

[21] Appl. No.: 83,526

[22] Filed: Aug. 7, 1987

[51] Int. Cl.[4] ..... E04G 3/08

[52] U.S. Cl. ..... 248/243

[58] Field of Search ..... 248/243, 245, 222.1, 248/223.1, 345.1, 345; D6/574; 108/107, 152

[56] References Cited

U.S. PATENT DOCUMENTS

| | | | |
|---|---|---|---|
| 2,215,331 | 9/1940 | Marsh | 248/345 X |
| 3,604,669 | 9/1971 | Asher | 248/243 |
| 3,606,229 | 9/1971 | Wall | 248/345 |
| 3,672,624 | 6/1972 | Keller | 248/243 |
| 4,431,155 | 2/1984 | Engel | 248/243 |
| 4,550,893 | 11/1985 | Wiersema et al. | 248/243 X |
| 4,566,662 | 1/1986 | Toshishige | 248/222.1 |

*Primary Examiner*—Ramon O. Ramirez

*Attorney, Agent, or Firm*—Donald W. Margolis; John L. Isaac

[57] ABSTRACT

An improved support system for a modular wall unit is disclosed. The support system includes an elongate support member mountable to a vertical surface. The support member has an inward face, an outward face, a depth dimension, a mechanism for mounting its inward face to the vertical surface, and a plurality of mechanisms spaced longitudinally along its outer surface for receiving one or more load bearing members. Load bearing members provide a base to which a load can be secured, with each including a mechanism for engaging the receiving means of the support member to adjustably locate and detachably mount the load bearing member to the support member. The support system also includes a unitary elongate pilaster having an inward face, an outward face, and a depth dimension. The pilaster defines a substantially centrally located elongate opening with the opening being sized and shaped to surround and substantially firmly engage a support member mounted on a vertical surface. The pilaster further includes a mechanism for mounting its inward face to a vertical surface to surround a support member and provide firm lateral support and firm vertical support to such a support member when such a support member has a load bearing member mounted on it and loading forces are imposed on such a load bearing member.

20 Claims, 1 Drawing Sheet

SUPPORT DEVICE FOR MODULAR WALL UNIT

BACKGROUND OF THE INVENTION

1. Field of the Invention

This invention relates generally to wall units and more particularly to wall units of the modular, removable type such as shelving or other load-bearing units. Specifically, the present invention relates to a support system for such modular load-bearing units which provides additional support and enhances the security and appearance thereof.

2. Description of the Prior Art

Modular wall units, especially for shelving for both the home and the office is of increasing popularity. Ease of assembly and adjustment of wall units such as shelving is of particular importance, either for the location of the modular wall units themselves as well as for the positioning of shelves or other load-bearing wall units to adjust the space thereinbetween.

Typical modular wall shelving units include a pair of support members or standards which are mountable directly to a vertical wall through the use of screws, bolts or any other suitable attachment mechanisms. These standards typically include a plurality of longitudinal slots, or other means for mechanically attaching load-bearing brackets spaced along the exterior face thereof. Brackets are then provided having means for attaching them to the standards, for example, such as at least a pair of hooks or other attachment members which securely engage with slots in the wall standard thereby removably attaching the bracket to the standard. These brackets are then readily positionable anywhere along the length of the wall standards which in turn have been secured at the desired location on a selected wall. Thus, the modular unit is readily attached to a wall surface and permits easy adjustment of the position of the shelf brackets thereof along the length of the unit. Examples of shelf bracket structures of this type are clearly illustrated in U.S. Pat. Nos. 3,604,669 and 3,672,624. Such structures have found considerable market appeal due to their ease of installation and adjustment as well as their inexpensive price structure.

Such modular wall units have generally experience several problems. One major problem of such wall units is that they tend to lack strength when subjected to loading and in particular lateral loading. This is somewhat dependent on the mechanism used to attach the standards to the walls. In most instances, such attachment mechanism are not particularly firm or permanent in order to prevent major damage to the wall when the wall shelving is removed. Therefore, additional support against both lateral and vertical forces would be highly desirable for such wall systems. Another problem that exists with such systems is that while these modular wall shelving arrangements are quite functional, they are generally very unsightly. Most of the existing wall standards and brackets are constructed from metal, and while attempts to decorate the metal members have been made, the component portions of the system generally still remain stark and unsightly. It would thus be highly desirable to provide additional support to modular wall systems which support would also provide aesthetic appeal as well as functional support.

SUMMARY OF THE INVENTION

Accordingly, it is one object of the present invention to provide a modular wall unit system.

It is another object of the present invention to provide a modular wall unit in the form of a shelving support system having increased stability characteristics.

It is another object of the present invention to provide a support member for a modular wall unit which not only provides enhanced support and stability, but also substantial aesthetic improvements.

To achieve the foregoing and other objects and in accordance with the purposes of the present invention, an improved support system for modular wall units is provided. The modular wall support system includes an elongate support member mountable to a vertical surface. The support member includes an inward face, an outward face, a depth dimension, a mechanism for mounting its inward face to the vertical surface, and a plurality of mechanisms spaced longitudinally along the outward face of the support member for receiving load bearing members. Load bearing members are provided to form a base to which a load can be secured with each load bearing member including a mechanism for engaging the receiving mechanisms of the support to adjustably located and detachably mount the load bearing member to the support member. A unitary elongate pilaster is provided and includes an inward face, an outward face and a depth dimension. In preferred embodiments the pilaster defines a substantially centrally located elongate opening with the opening being sized and shaped to surround and substantially firmly engage a support member mounted on a vertical surface. The pilaster further includes a mechanism for mounting its inward face to a vertical surface to surround a support member and provide firm lateral support and firm vertical support to such a support member when such a support member has a load bearing member mounted on it and loading forces are imposed on such a load bearing member.

BRIEF DESCRIPTION OF THE DRAWINGS

The features of the present invention which are believed to be novel are set forth with particularity in the appended claims. The invention, together with further objects and advantages thereof, may best be understood by reference to the following detailed description taken in conjunction with the accompanying drawings, in which:

DETAILED DESCRIPTION OF THE PREFERRED EMBODIMENTS

Figure 1:
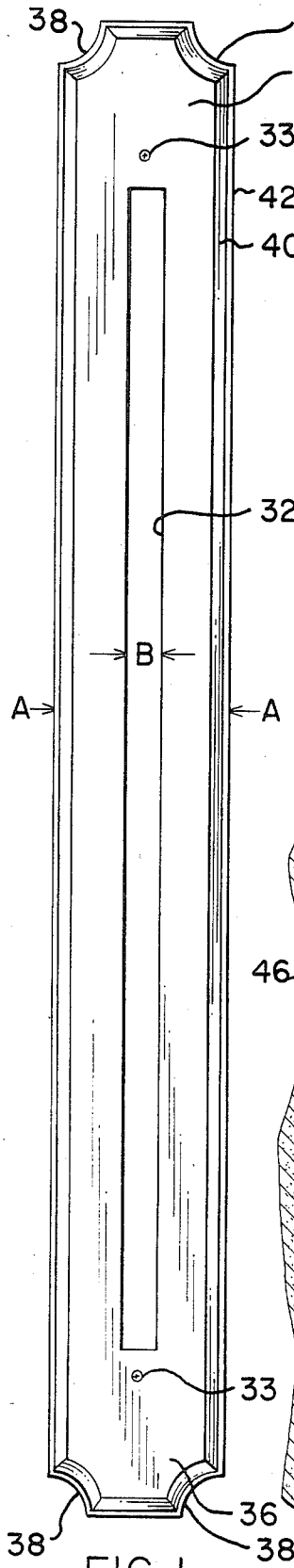
FIG. 1 is a front elevational view of the support member of the present invention.
Figure 2:
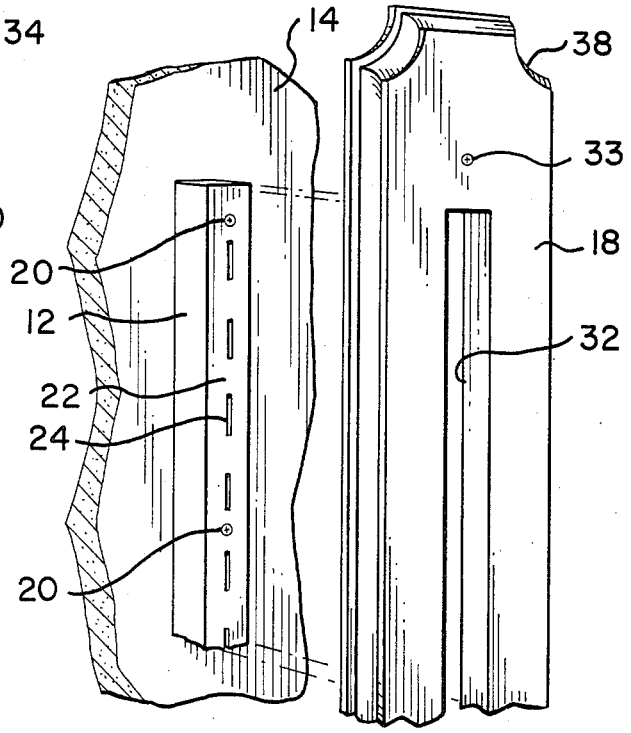
FIG. 2 is an exploded partial front perspective of the upper portion of the support member of FIG. 1 aligned for mounting to a standard member positioned on a wall.
Figure 3:
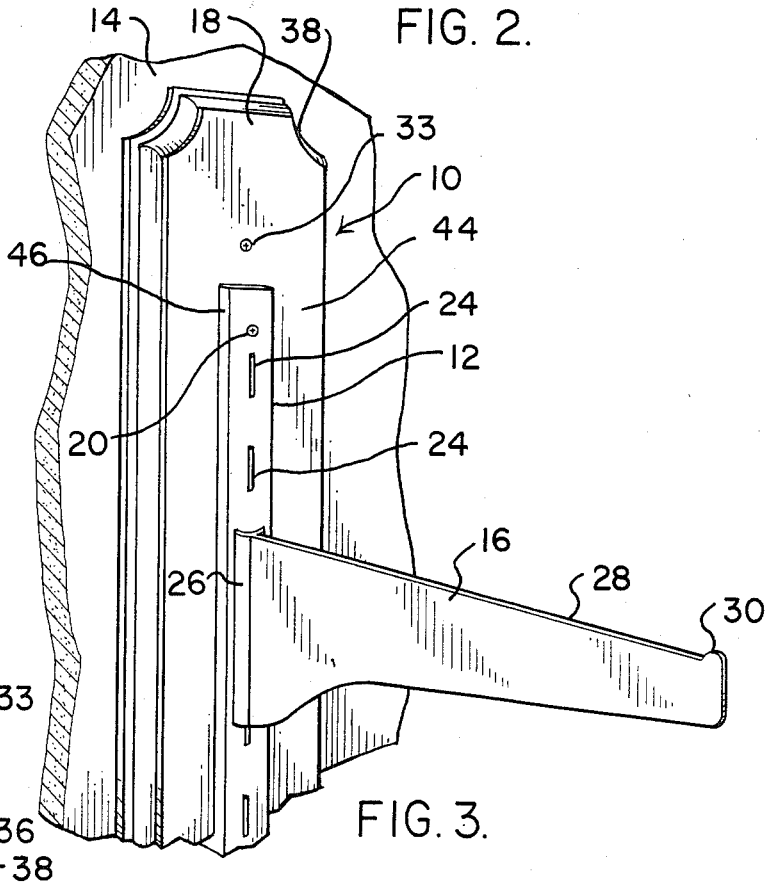
FIG. 3 is a view similar to FIG. 2 illustrating the support member of FIG. 2 fully mounted to wall surface in support position about a modular wall standard and bracket.

Referring to FIGS. 1 - 3, a modular wall support system, generally 10, is illustrated. The system 10 includes a support member or standard 12 which is mountable to a vertical wall surface 14, a load bearing member such as the illustrated bracket 16 and a pilaster support member 18. Together the members 12 and 18 form the modular wall unit support system which is capable of receiving a wide variety of load bearing elements such as the brackets 16. The support standard 12 is an elongate member preferably rectangular in shape constructed from any desired material, but is preferably made of metal. The member 12 is mountable to a vertical wall surface 14 by any desired means such as screws, wing clips, anchor bolts and the like. The illustrated mechanism includes a plurality of screws 20 that pass through the front surface 22 of the standard 12 and are secured in the wall 14 by any appropriate or desired mechanism. The number of screws 20 and the manner of securing the screws 30 to the wall 14 will determine to a great degree the stability of the solitary standard 12 on the wall 14.

The support standard 12, as illustrated includes a plurality of bracket receiving means such as elongate slots 24 disposed along the center line of the front face 22. It should be noted, however, that any kind of desired means or mechanism can be utilized along the front face 22 to attach load bearing members thereto. The illustrated slots 24 are sized and spaced so as to engage with at least a pair of art known hooks (not illustrated) or other attachment members projecting from the base end 26 of the bracket 16. These attachment members are spaced similarly to the spacing between the bracket receiving means such as elongate slots 24 to allow the bracket 16 to be mounted against and to the standard 20 along any longitudinal position thereof so as to engage any desired bracket receiving means of pair of slots 24.

The illustrated load bearing member is a shelving bracket 16 of conventionally known design and includes a shelving support edge 28 which engages an art known shelf member (not illustrated) of sufficient size to be positioned firmly between the front face 22 of the standard 20 and the tip 30 of the bracket 16. The bracket 16 may be constructed from any desired material, but is also preferably made of metal similar to that of the standard 12. As previously indicated, the bracket 16 may be engaged with any bracket receiving means or selected pair of slots 24 along the length of the standard 12 so as to adjustably position and mount the bracket 16 along the length of the standard 12. This adjustable mounting permits variation of the distance between vertically spaced brackets along the length of the standard 12. While the illustrated member 16 is a shelf bracket, any type of load bearing member may be used in conjunction with the present invention.

The above construction of the wall unit can be somewhat unstable, especially when subjected to lateral loads, as well as aesthetically unappealing. To remedy these problems, a unitary pilaster support 18 is provided. The pilaster 18 is preferably substantially rectangular in shape and defines a substantially central elongate slot or opening 32 therein. The inner dimensions of opening 32 are specifically sized and shaped to substantially the same width and length dimensions as the outer dimensions of standard 12 so as to substantially firmly receive and snugly engage the standard 12 when it is positioned therein. Thus, the pilaster 18 is substantially press fitted to surround the standard 12 after the standard 12 has been mounted to the wall 14. The pilaster 18 may then be subsequently attached to the wall 14 by any desired mechanism or means, such as screws, construction adhesive, double-sided tape or the like. Consequently, the pilaster 18 provides firm lateral support as well as vertical support to the standard 12 when it is subjected to loading forces, such support being far in excess of that provided by the support standard 12 alone.

The pilaster 18 may be constructed from any desired material, such as metal, wood, fiberboard, particle board, fiberglass, plastic or the like. It is preferred that the pilaster 18 be constructed from solid material to provide firm structural support to the standard 12. Thus, wood or fiberboard is the preferred material, since such material is relatively inexpensive, strong and will provide the desired support to the standard 12.

In its preferred form, the pilaster 18 of the present invention includes upper and lower end portions 34 and 36 which are unitary with the remainder of the substantially rectangular shaped pilaster 18. Thus, the total unitary structure of the pilaster 18 provides considerable support to the standard 12, which support is not available by other units having modular end pieces that are not unitary with the side structural portions of the pilaster 18. In its preferred form, the overall width A—A of the pilaster 18 is at least three times as great as the width B—B of the slot 32. In this manner, substantial bulk is provided on either side of the standard 12 to provide the desired support. Anything less than generally three times the width of the slot B which corresponds to the width dimension of the support standard 12 will not provide the optimum support to the standard 12.

The pilaster 18 includes four corners 38 which are shown to be arcuately curved. The peripheral edges 40 of the substantially rectangular pilaster 18 is preferably bevelled or chamfered in a rounded manner to provide not only an aesthetically pleasing appearance, but also to enable easier handling and grasping of the pilaster 18 when mounting it to the wall 14 about the standard 12. In conjunction with the shaped peripheral edges 40, a peripheral ledge 42 is provided entirely about pilaster 18 operating in conjunction with the shaped edges 40 for ease of handling and mounting against the wall 14. These functional characteristics also provide considerable improvement in the aestheric appearance of the pilaster 18. Further to this end, front face 44 of pilaster 18 may be decorated, for example, by staining, painting, wood-burning, embossing, laminating, or the like.

To mount the modular shelving system 10, the vertical support standard 12 is located in the desired position along a vertical wall 14. It may then be secured to the wall by, for example, attachment members 20. The pilaster 18 having an appropriately sized and shaped slotted aperture 22 is then substantially press fitted about the standard 12. It may then be secured to the face of the wall 14 utilizing attachment member 33. It should be noted that in FIG. 3 the depth of the standard 12 is shown to be greater than the depth of the pilaster 18 so that a portion 46 of the standard 12 projects outwardly beyond the front face 44 of the pilaster 18. This also provides aesthetic appeal as well as permitting easier attachment and detachment of the shelving brackets 16 to the standard 12. However, the depth of standard 12 may be the same as or less than the depth of pilaster 18. Once the pilaster 18 has been so mounted to the wall 14 about the standard 12, the load bearing brackets 16 are positioned in their desired locations along the standard 12, and shelves or other units are mounted accordingly thereto.

As can be seen from the above, the support system of the present invention provides substantially enhanced structural support for existing modular wall units as well as provides additional aesthetic appearance. The pilaster 18 can be decorated or made as ornate as is desired to provide a variety of different aesthetic appearance in accordance with the needs and desires of the user. Thus, the pilaster 18 of the present invention provides both aesthetic appearance as well as substantial structural support to the modular wall system which has heretofore not been available. Finally, the support system of the present invention is easily adapted to any existing modular wall shelving system and is constructed inexpensively so as to provide desired additional support without significantly increased expense.

The foregoing description of the construction of the present invention is exemplary only, and the scope of the present invention is to be limited to the appended claims as interpreted in view of the prior art. Equivalent construction and compositions may be employed, as described, to provide the objectives and advantages described herein.

What is claimed is:

1. In a modular wall unit support system including in combination an elongate support member mountable to a vertical surface, said support member including an inward face and an outward face and a depth dimension, means for mounting said inward face of said support member to said vertical surface, and further including means for receiving one or more load bearing members, said receiving means being spaced longitudinally along said outward face of said support member; and said load bearing members providing a base to which a load can be secured, each load bearing member including means for engaging said receiving means of said support to adjustably located and detachably mount said loading bearing member to said support member, wherein the improvement comprises:

a unitary elongated pilaster, said pilaster including an inward face and an outward face and a depth dimension, and defining a substantially centrally elongate opening, said opening being sized and shaped to surround and substantially firmly engage a support member mounted on a vertical surface, and provide firm lateral support and firm vertical support to such a support member when such a support member has a load bearing member mounted on it and loading forces are imposed on such a load bearing member.

2. The support system as claimed in claim 1, wherein said elongate central opening defined within said pilaster is sized and shaped to provide a substantially snug fit with a support member which it surrounds to thereby provide support to said pilaster.

3. The support system as claimed in claim 1, wherein said pilaster includes means for mounting its said inward face to a vertical surface.

4. The support system as claimed in claim 2, wherein the depth of said pilaster, including the depth of said central opening defined within said pilaster, is equal to the depth of a support member which it will surround, to thereby permit such a support member to be substantially coplanar with said front face of said pilaster.

5. The support system as claimed in claim 2, wherein the depth of said pilaster, including the depth of said central opening defined within said pilaster, is less than the depth of a support member which it will surround, to thereby permit such a support member to project beyond said front face of said pilaster.

6. The support system as claimed in claim 1, wherein said unitary pilaster totally surrounds and substantially snugly fits against a support member.

7. The support system as claimed in claim 6, wherein said pilaster is rectangular in shape.

8. The support system as claimed in claim 7, wherein said rectangular pilaster has corners and said corners of said pilaster are contoured.

9. The support system as claimed in claim 8, wherein said pilaster has edges and said edges of said pilaster are chamfered to improve the handling of said pilaster during its mounting on a vertical surface.

10. A support system for modular wall shelving including at least one elongate standard having a front face and also having a rear face mountable to a wall, means disposed in said front face of said standard for receiving and securing brackets, and at least one bracket removably securable to said receiving and securing means of said standard, wherein said support system includes a singular support plate having an exterior front face, and a rear face and defining a central slot, said rear face of said support plate being mountable to a wall to surround said standard and thereby provide lateral support and vertical support to said standard against its movement when said standard is subjected to loads imposed on any said bracket.

11. The support system as claimed in claim 10, wherein said central slot of said support plate is sized and shaped to firmly, slidably engage said standard, whereby said support plate provides lateral support and vertical support to said standard.

12. The support system as claimed in claim 11, wherein said central slot defined by said support plate and said standard are both substantially rectangular in shape.

13. The support system as claimed in claim 12, wherein when said support plate surrounds said standard and said standard is coplanar with said exterior front face of said support plate.

14. The support system as claimed in claim 13, wherein said plate comprises a unitary pilaster having corners and edges, and said corners and edges are contoured to provide, in combination, improved handling of said pilaster during the step of mounting it on a vertical surface to provide lateral and vertical support to said standard and such contours also provide improved exterior surface aesthetic appearance.

15. The support system as claimed in claim 12, wherein said plate is substantially rectangular in shape and has edges, said edges of said plate being chamfered to permit improved handling during mounting thereof on a vertical surface.

16. The support system as claimed in claim 10, wherein said plate and said standard each have a width dimension, and the width of said plate is at least three times the width of said standard contained therein.

17. A pilaster for modular shelving units having wall standards removably mounted to a wall and means removably securable to said standards for supporting shelving members, said pilaster comprising an elongate support plate having an exterior front face and defining a substantially central elongate opening for receiving and surrounding one of said standards, said support plate being mountable to a wall to surround said standard and thereby provide support against movement of said standard when it is subjected to loads imposed on said shelving support means.

18. The pilaster as claimed in claim 17, wherein said pilaster and said one standard each have a depth dimension and are each substantially rectangular in shape, said central opening being sized and shaped to snugly receive and surround said standard with the depth of said pilaster, including the depth of said central opening defined within said pilaster, being equal to the depth dimension of the standard to thereby permit said standard to be substantially coplanar with said exterior face of said pilaster.

19. The pilaster as claimed in claim 17, wherein said pilaster and said one standard each have a depth dimension and are each substantially rectangular in shape, said central opening being sized and shaped to snugly receive and surround said standard with the depth dimension of said pilaster and said central opening being less than standard to thereby permit said standard to project beyond the exterior face of said pilaster.

20. The pilaster as claimed in claim 17, wherein said pilaster includes means for mounting it to a vertical wall surface independent of any means which are provided for mounting said wall standards to a vertical wall surface.

* * * * *